US005975006A

United States Patent [19]

Lewit

[11] Patent Number: 5,975,006

[45] Date of Patent: Nov. 2, 1999

[54] ENERGY ABSORBING BULKHEAD FOR A KAYAK

[76] Inventor: Benjamin Lewit, 7513 Carroll Ave. Apt. 3, Takoma Park, Md. 20912

[21] Appl. No.: 09/003,587

[22] Filed: Jan. 6, 1998

[51] Int. Cl.[6] ..... B63B 17/00; B63B 35/00

[52] U.S. Cl. ..... 114/363; 114/347

[58] Field of Search ..... 114/363, 78, 347, 114/343; 440/25, 24; 280/252, 253, 254

[56] References Cited

U.S. PATENT DOCUMENTS

| | | | |
|---|---|---|---|
| 304,474 | 9/1884 | Turpel | 114/363 |
| 3,982,293 | 9/1976 | Lagervall . | |
| 4,244,602 | 1/1981 | Allsop et al. | 280/821 |
| 4,744,327 | 5/1988 | Masters . | |
| 4,942,840 | 7/1990 | Masters . | |
| 5,367,976 | 11/1994 | Van Schaik | 114/347 |
| 5,544,613 | 8/1996 | Scarborough et al. . | |

*Primary Examiner*—Sherman Basinger
*Assistant Examiner*—Patrick Muldoon
*Attorney, Agent, or Firm*—Shlesinger Arkwright & Garvey LLP

[57] ABSTRACT

The invention is directed a damping system for the foot rest of a kayak comprising a foot support member adapted to support the feet of the user, at least one mounting rail is provided, the rail having first and second ends, the first end of the mounting rail is connected to the foot support, the second end of the mounting rail is fixed to the hull of the boat, the mounting rail includes a damping mechanism disposed between the first and second end whereby forces transmitted to the fixed second end are damped at the foot support member.

7 Claims, 5 Drawing Sheets

ENERGY ABSORBING BULKHEAD FOR A KAYAK

FIELD OF THE INVENTION

The present invention relates to improvements in kayaks and in particular, the footrest for a kayak.

BACKGROUND OF THE INVENTION

Whitewater kayaks employ either of two basic foot rest systems. A pair of individual foot pegs may be provided to separately support each foot or, the user will rest his feet against a bulkhead disposed in the bow.

Foot pegs are not entirely satisfactory because they provide a limited surface area for contact with the user's feet. In addition, they are unwieldy and not very rigid. As a result, sudden and extreme movements of the boat will cause the user's feet to slip off of the foot pegs. Loss of foot peg support when the boat is engaged in whitewater is dangerous. Without foot support, the user is caused to slide forward and into the bow of the kayak, thereby limiting control of the boat.

In addition, impact of the boat against rocks or the like often results in twisted or even broken ankles. The forces generated during impact are directly transmitted to the user's feet and legs.

At least one prior art foot peg system incorporates cushioning into the foot peg itself. U.S. Pat. No. 4,744,327 to Masters provides a cushion for each foot peg for absorbing shock. As is apparent, such foam cushioning provides limited damping ability. Further, individual foot pegs are prone to breakage and cannot securely support the feet of the user.

In view of the above, a need has existed in the art for providing efficient damping to the foot brace of a kayak.

OBJECTS AND SUMMARY OF THE INVENTION

It is therefore an object of the invention to provide a bulkhead wall damping system adapted to provide the paddler with good support during normal conditions yet sufficiently absorb shock transmitted to the feet of the paddler during severe impact of the boat.

Another object is to provide a foot support system for use within a kayak as an alternative to individual foot pegs and that is rigid, provides good foot support and includes a damping mechanism.

A still further object of the present invention is to adapt a single, unitary bulkhead for use as a footrest for a kayak.

It is a further object of the present invention to provide a single piece bulkhead adapted to move along the longitudinal axis of the boat during impact.

Yet another object of the present invention is to provide a damping member within the side rails of a foot rest or bulkhead.

A still further object of the present invention is to provide a damping system for a kayak that readily incorporates a spring, pneumatic or hydraulic system.

Another object of the present invention is to provide a lightweight damping system for a kayak that is simple in construction.

Another object of the present invention is to provide a lightweight damping system for a bulkhead wall of a kayak that is reliable and readily fitted into a conventional kayak design.

A still further object of the present invention is to provide a damping system for a kayak that will provide a firm support for the paddler's feet while kayaking under any conditions.

An additional object of the present invention is to provide a damping mechanism adapted to fully damp forces transmitted to the users feet during impact of the boat.

The present invention is directed a foot rest damping system for a kayak comprising a bulkhead member adapted for positioning within the hull of a kayak and for supporting the feet of a user, at least one mounting rail is provided, the rail having first and second ends, the first end of the mounting rail is connected to the bulkhead, the second end of the mounting rail is fixed to the hull of a boat, the mounting rail includes a damping device disposed between the first and second end whereby forces transmitted to the fixed second end are caused to be damped at the bulkhead.

These and other objects of the present invention will become apparent from the following drawings and detailed specification taken together with the representative examples.

DETAILED DESCRIPTION OF THE PREFERRED EMBODIMENTS

Figure 1:
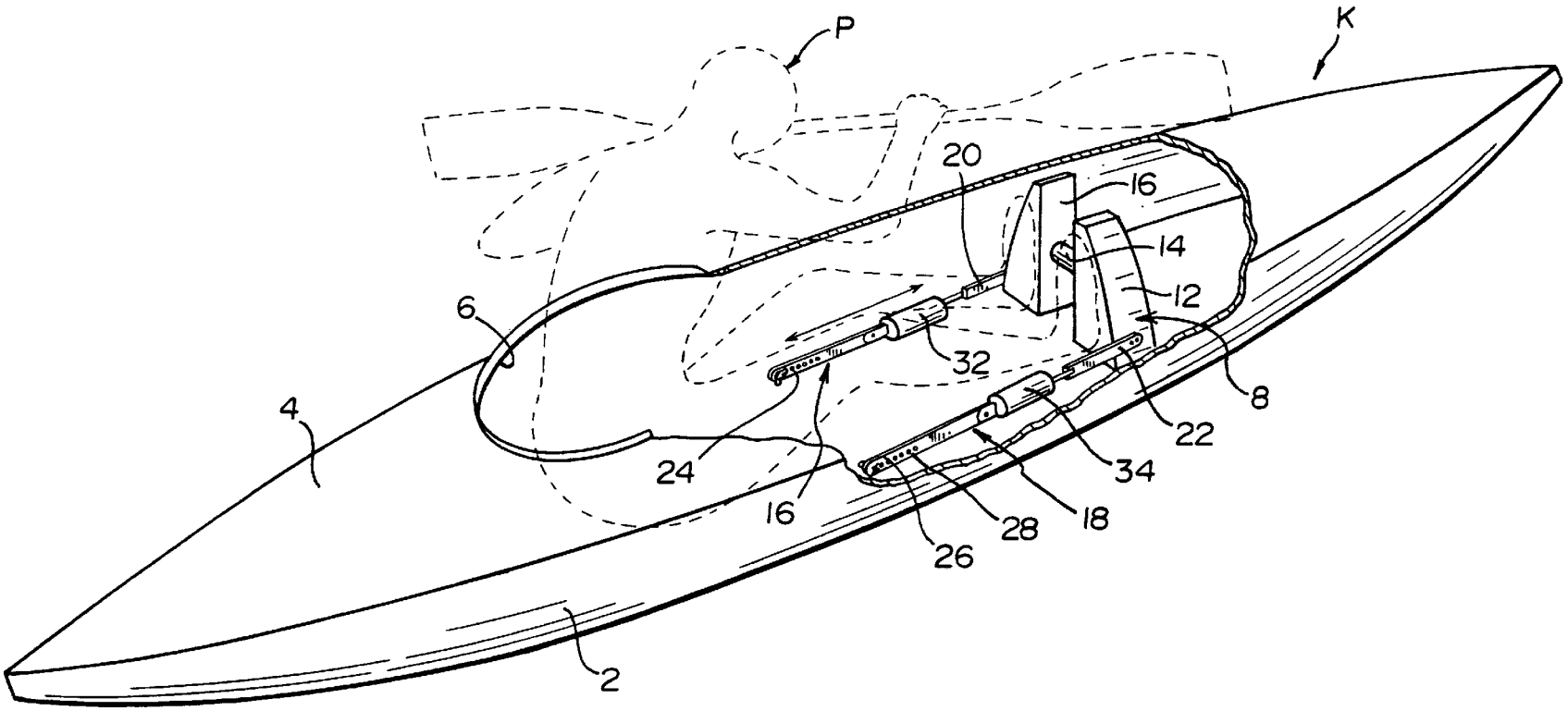
FIG. 1 is a perspective view of kayak having a portion broken away to illustrate the damping system according to the present invention and showing in phantom lines a paddler seated within the kayak.
Figure 2:
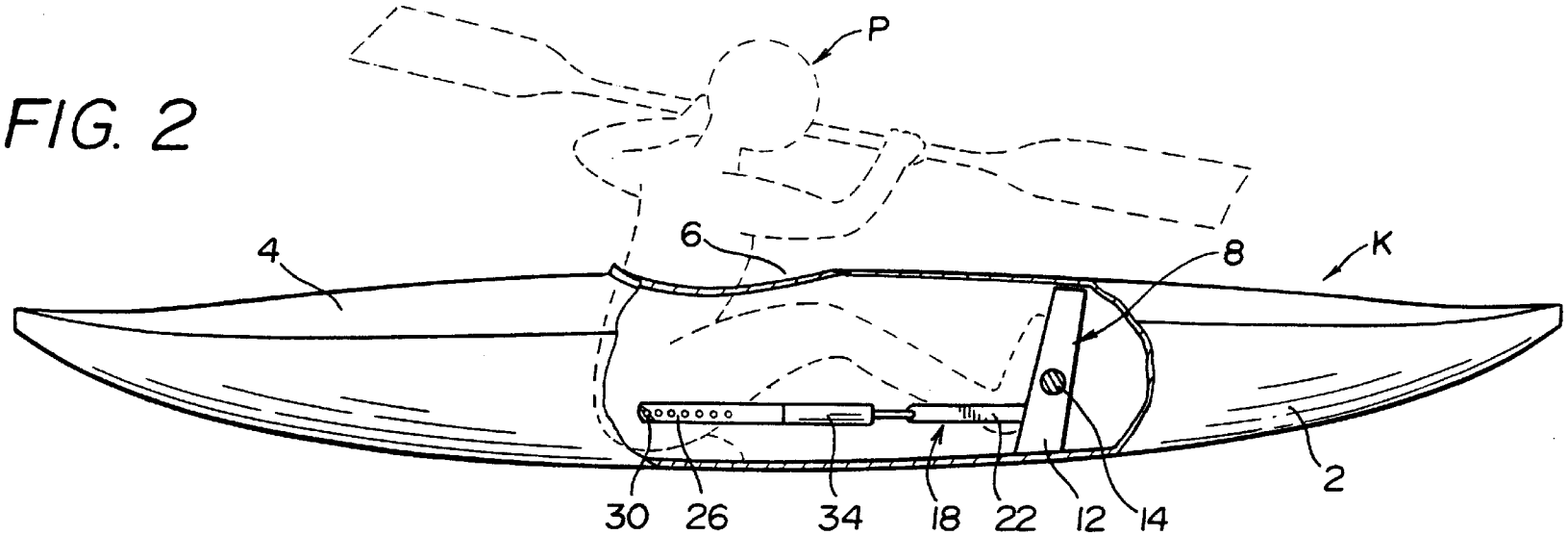
FIG. 2 is a side elevational view of the kayak shown in FIG. 1 with the bulkhead shown in cross-section and including an arrows showing the direction of movement of the bulkhead during damping.

Turning to FIGS. 1 and 2, a kayak K is shown and generally includes a hull 2 and deck 4. A cockpit 6 is formed on the deck 4 and shown in the figures to seat a paddler P. While in the seated position, the paddler P is positioned on a seat (not shown) with legs forward and knees slightly bent.

A foot support member, shown in the drawing to comprise a bulkhead 8 is provided and positioned in the forward portion or bow of kayak K and in the manner known in the art. The bulkhead 8 shown in FIGS. 1 and 2 comprises a unitary foot support member providing support to the hull of the boat and includes first and second portions 10 and 12 rendered unitary by cross member 14. The bulkhead forming the foot support member according to the present invention is not secured to the hull of the kayak but is adapted to lie adjacent and move relative to the interior wall of the kayak.

Figure 6A:
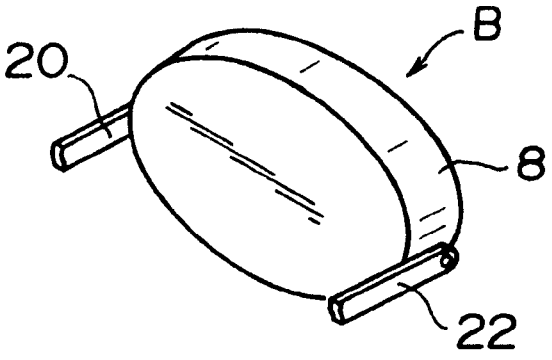
FIGS. 6*a* and 6*b* illustrate bulkhead designs according to the present invention.
Figure 6B:
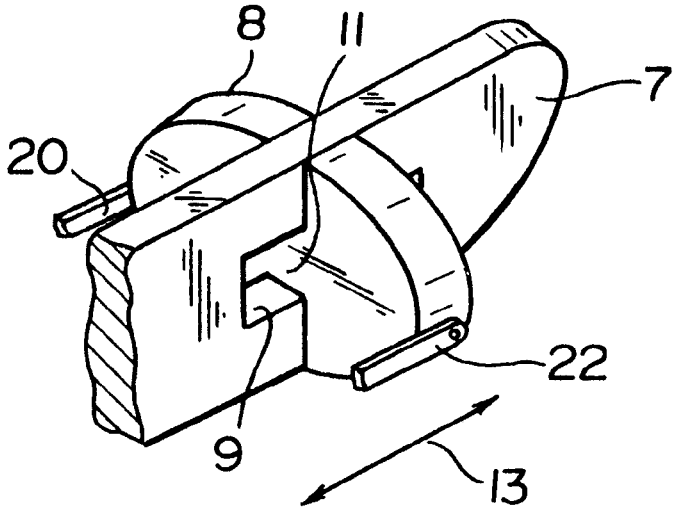

As is apparent, other foot support members are within the scope of the present invention. While a bulkhead as shown in the drawings and otherwise known in the art is preferred, other rigid and unitary members fashioned to support the feet of the user but not functioning as a bulkhead are within the scope of the present invention. As best shown in FIG. 6*a*, the foot support member may comprise a bulkhead 8 having an oval shape. In the alternative and as shown in FIG. 6*b*, the foot support member may comprise a bulkhead 8 adapted to interfit a front wall 7 as is known in the art. The front wall 7 including a cutout 9 through which extends crossmember 11. The bulkhead is adapted according to the present invention to move in the direction of arrow 13 as will further be explained below.

Turning to FIGS. 1 and 2, it can be seen that secured to each of the first portion 10 and second portion 12 of the bulkhead 8 are respective side or mounting rails 16 and 18. Each of the side rails are constructed from aluminum or other material as is known in the art and extend along the length of the boat from first respective ends 20 and 22 to opposite second ends 24 and 26. The rail first ends 20 and 22 are secured to the bulkhead by the use of pins or other rigid mounting device to securely affix each of the first ends to the sides of the bulkhead 8.

As shown in FIGS. 1 and 2, the sides of the bulkhead 8 extend on each of the respective first portions 10 and second portions 12 of the bulkhead. As is apparent, the connection of the first rail ends 20 and 22 to the bulkhead may be modified within the scope of the present invention. For example, each of the rail first ends may be secured at any of several positions from the top of the bulkhead wall 8 to the bottom as shown in FIGS. 1 and 2. As shown in FIG. 2, the rail first end 22 may be secured to the bulkhead wall 8 at a position adjacent cross member 14. Each of the rail second ends 24 and 26 are fixed to the hull 2 of the kayak or otherwise rigidly secured to the boat. The mechanism for securing the rail second ends 24 and 26 to the boat may be adjustable to allow the rails to be lengthened or shortened depending upon the paddler's P legs. For example, a plurality of oval shaped openings 28 may be formed into the rails and a locking pin 30 or other means may pass through the openings 28 and be otherwise secured to the hull 2 of the kayak K.

Each of the side rails 16 and 18 further include a damping mechanism 32 and 34 respectively. A damping mechanism according to the present invention is disposed along the longitudinal axis of the rail and between each of the first and second rail ends and is adapted to absorb shocks transmitted through the rails thereby preventing shock impact against the boater's foot when supported by the bulkhead wall 8

Figure 3A:
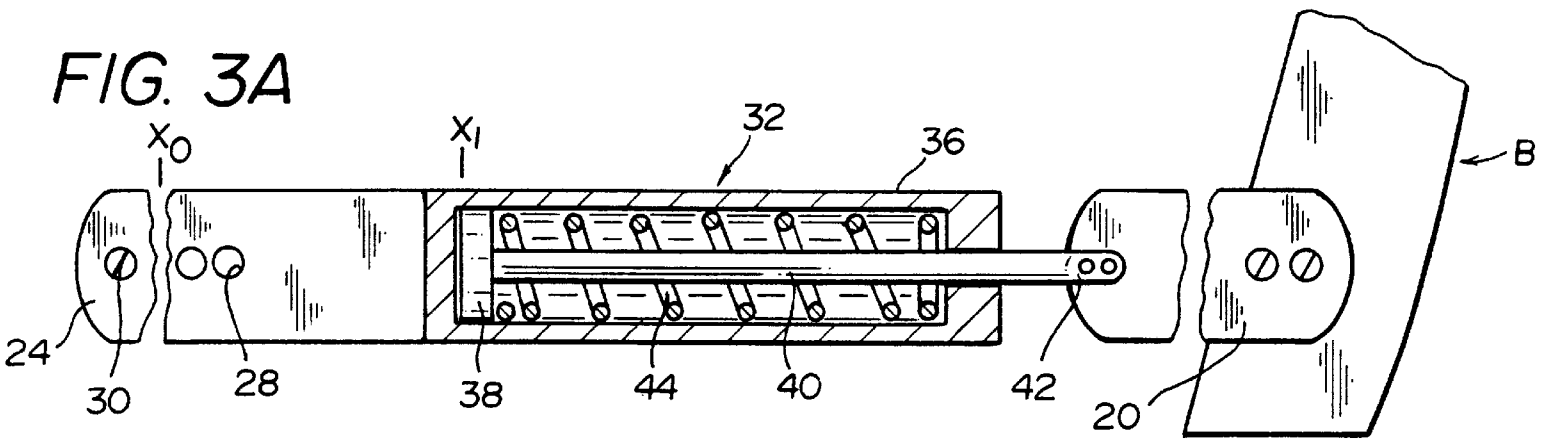
FIGS. 3A and 3B illustrate a damping mechanism according to the present invention before and during damping.
Figure 3B:
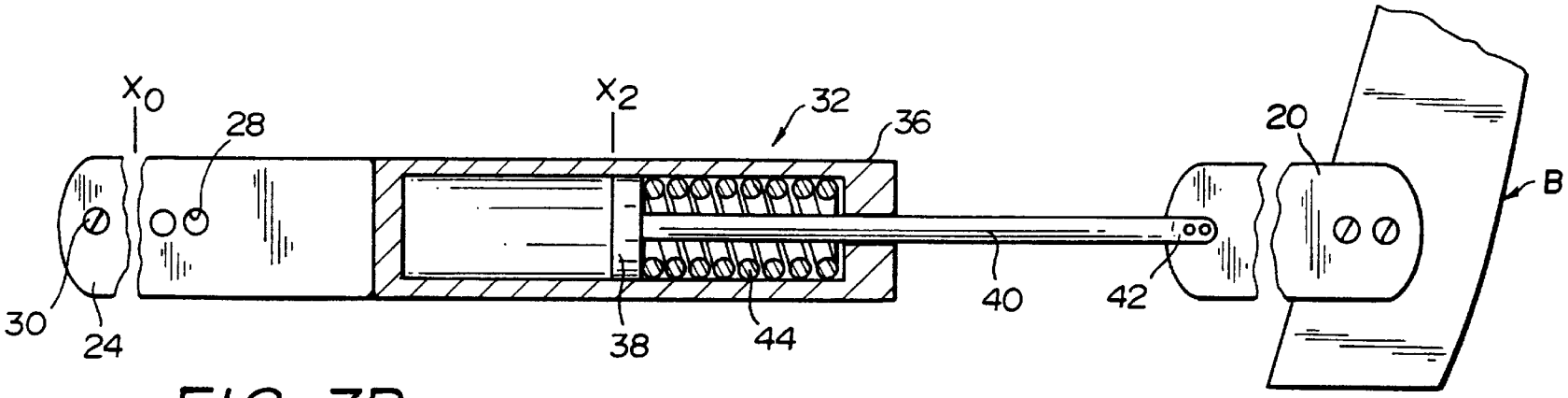

Turning now to FIGS. 3A and 3B the damping system according to the present invention and in particular the damping mechanism 32 can be seen during operation. More particularly, FIG. 3A illustrates a bulkhead wall B secured at the rail first end 20 to damping mechanism 32 and a rail second end 24 fixedly secured to the hull 2 (not shown) by pin 30 or other securing device. The damping mechanism 32 in the FIG. 3A embodiment is shown to comprise a housing 36 having a slidable piston 38 and rod member 40 slidable along the longitudinal axes of the housing 36 and connected at an opposite end 42 to the rail first end 20. The housing 36 is also connected to the rail second end 24 in a rigid or otherwise fixed manner. Prior to actuation of the damping mechanism 32, the fixed rail second end 24 is shown at position $X_0$ and the piston 38 is shown at position $X_1$. If the kayak strikes an object in the water, the damping mechanism 32 is caused to dampen shock transmitted to the bulkhead or foot support by way of expanded spring member 44, which is compressed into position $X_2$ as shown in FIG. 3B thereby absorbing energy that would otherwise be transmitted to the paddler's feet resting against bulkhead wall B. The bulkhead is caused to be moved along the longitudinal axis of the boat a short distance, typically about 5 cm., during damping.

Figure 4A:
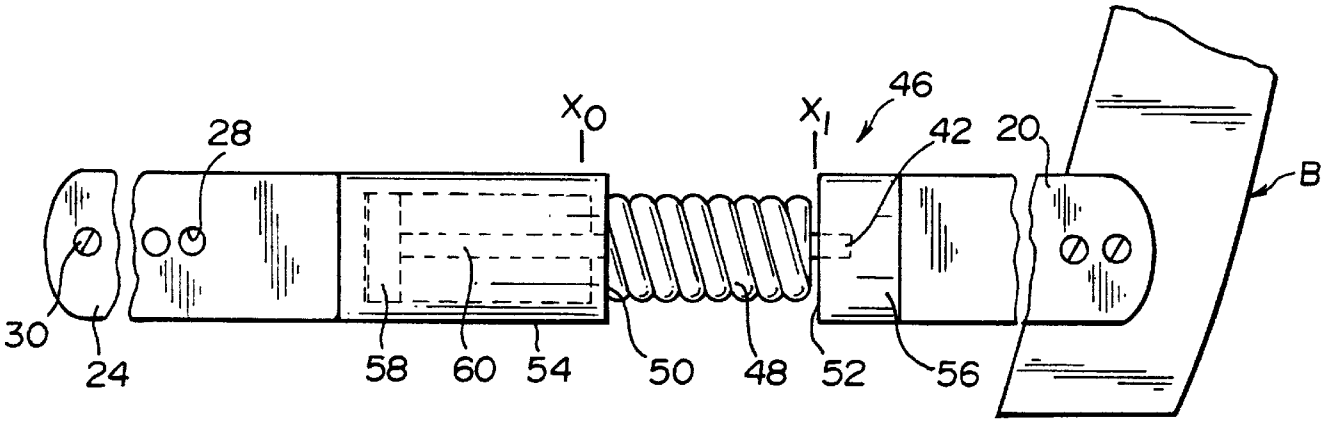
FIGS. 4A and 4B illustrate an alternative damping device according to the present before and during damping.
Figure 4B:
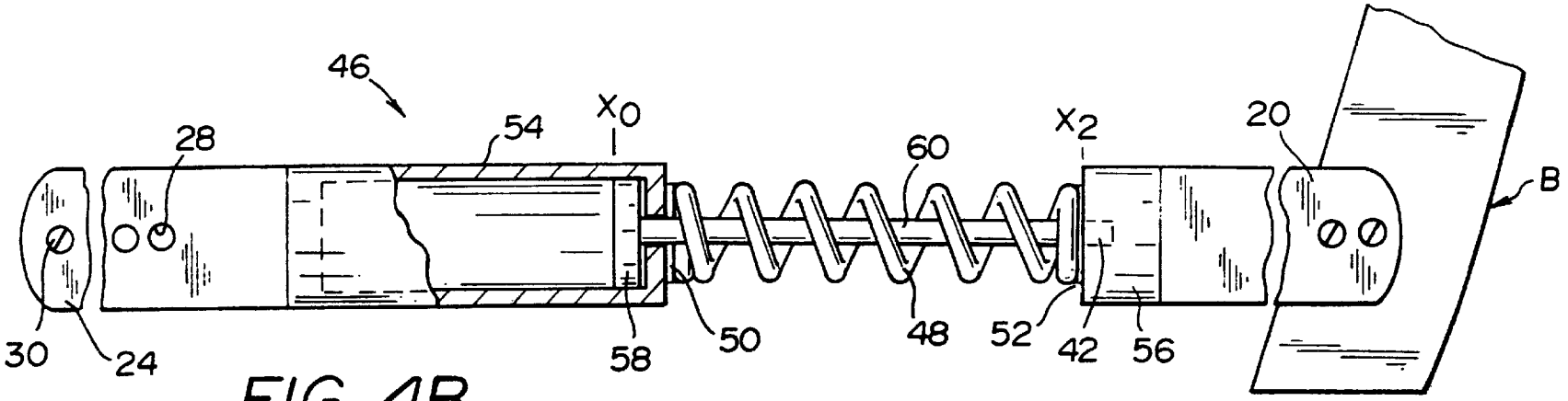

Turning to FIGS. 4A and 4B, an alternative embodiment of the damping mechanism according to the present invention is shown whereby a damping mechanism 46 comprises a spring member 48 fixed at each of ends 50 and 52 to housing 54 and rail end 56 respectively. A piston 58 or stop member and rod 60 are disposed in housing 54 to limit expansion of spring or coil 48 during operation. As best shown in FIG. 4A, the damping mechanism 46 is in position $X_0$ and $X_1$ when at rest. FIG. 4B illustrates the mechanism during operation, the coil or spring 48 expanding to the position $X_0$ and $X_2$ and effectively damping the forces transmitted into the kayak as it strikes an object or is otherwise caused to be shaken.

Figure 5:
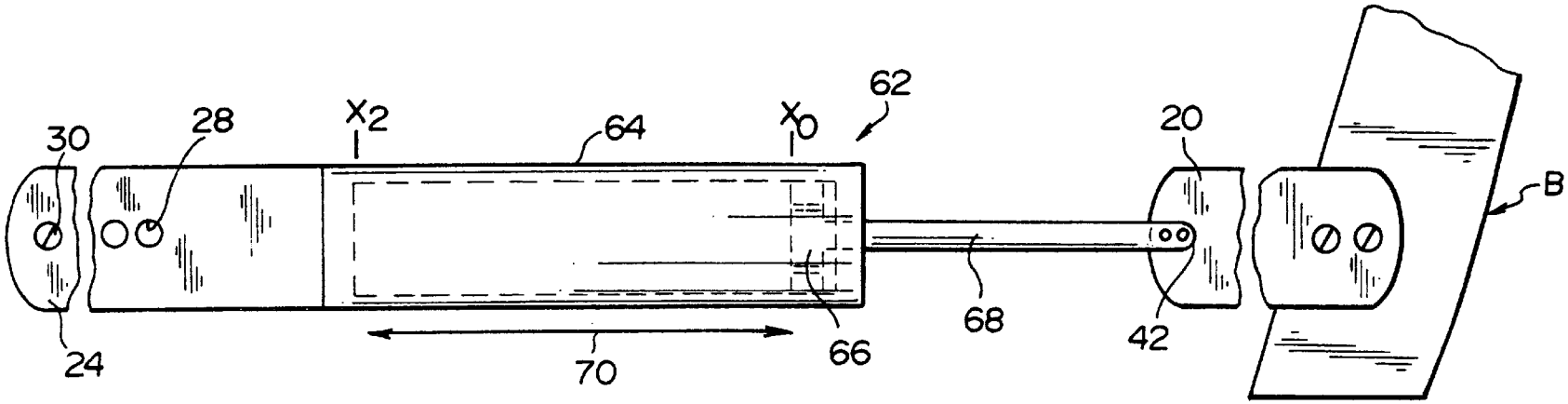
FIG. 5 illustrates an alternative embodiment of the present invention.

As best shown in FIG. 5 an additional alternative embodiment: of the present invention is shown whereby a hydraulic or pneumatic damping mechanism 62 is provided and comprises a housing 64 having a piston 66 and rod 68 connected to a rail first end 20 and rail second or fixed end 24 respectively. A fluid system (not shown) together with piston 66 functions to damp shocks transmitted to the rail and bulkhead B positions $X_0$ and $X_2$ and in the direction of arrow 70.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A foot rest system for a kayak comprising:

a) a foot support member adapted to support both feet of the user;

b) at least one mounting rail, said at least one mounting rail having first and second ends, said first end of said at least one mounting rail is connected to said foot support member, said at least one mounting rail second end is adapted to be fixed to the hull of a kayak;

c) a damping mechanism connected to said at least one mounting rail and positioned between said first and second ends whereby forces transmitted to said fixed second end are caused to be damped at said foot support member;

d) said damping mechanism comprising a housing, said housing having first and second ends, said housing first end attached to said mounting rail second end, said housing second end operably attached to said mounting rail first end;

e) a piston disposed in said housing and reciprocable therein;

f) a piston rod having first and second ends, said piston rod first end operably attached to said housing first end, said piston rod second end operably attached to said mounting rail first end; and g) a spring member operably associated with said piston and said piston rod, said spring member having first and second positions, said spring member in the first position prior to receiving an impact force to be damped, said spring member in the second position after the impact force has been damped.

2. A foot rest system for a kayak as in claim 1 wherein:

a) said spring member is disposed within said housing, said spring member having first and second ends, said spring member first end is operably attached to said housing first end, said spring member second end is operably attached to said piston, said spring member adapted to expand to the second position from the first position for damping purposes.

3. A foot rest system for a kayak as in claim 1, wherein:

a) said spring member is disposed within said housing and positioned between said piston and said housing second end, said spring member adapted to compress to the second position from the first position for damping purposes.

4. A foot rest system for a kayak as in claim 1 wherein:

a) said spring member is disposed exterior of said housing, said spring member having first and second ends, said spring member first end is operably attached to said housing second end, said spring member second end is operably attached to said mounting rail first end, said spring member adapted to expand to the second position from the first position for damping purposes.

5. A foot rest system for a kayak as in claim 1 wherein:

a) said damping mechanism is a shock absorber.

6. A foot rest system for a kayak comprising:

a) a foot support member adapted to support both feet of the user;

b) at least one mounting rail, said at least one mounting rail having first and second ends, said first end of said at least one mounting rail is connected to said foot support member, said at least one mounting rail second end is adapted to be fixed to the hull of a kayak;

c) a damping mechanism connected to said at least one mounting rail and positioned between said first and second ends whereby forces transmitted to said fixed second end are caused to be damped at said foot support member;

d) said damping mechanism comprises a housing, said housing having first and second ends, said housing first end operably attached to said mounting rail second end, said housing second end operably attached to said mounting rail first end, said housing being sealed;

e) a piston disposed in said housing and reciprocable therein;

f) a piston rod having first and second ends, said piston rod first end operably attached to said housing first end, said piston rod second end attached to said mounting rail first end; and, g) a fluid disposed inside said sealed housing, said fluid operably associated with said piston and said piston rod, said piston having first and second positions, said piston in the first position prior to receiving an impact force to be damped, said piston in the second position after the impact force has been damped, said fluid adapted to be compressed by said piston for damping purposes.

7. A foot rest system for a kayak as in claim 6 wherein:

a) said fluid is selected from the group consisting of liquid and gas.

* * * * *